US005084091A

United States Patent [19]

Yolton

[11] Patent Number: 5,084,091

[45] Date of Patent: Jan. 28, 1992

[54] METHOD FOR PRODUCING TITANIUM PARTICLES

[75] Inventor: Charles F. Yolton, Coraopolis, Pa.

[73] Assignee: Crucible Materials Corporation, Pittsburgh, Pa.

[21] Appl. No.: 433,906

[22] Filed: Nov. 9, 1989

[51] Int. Cl.[5] ..... C22B 9/00

[52] U.S. Cl. ..... 75/336; 75/338

[58] Field of Search ..... 75/336, 338

[56] References Cited

U.S. PATENT DOCUMENTS 4,272,463 6/1981 Clark et al. ..... 75/338
4,544,404 10/1985 Yolton et al. ..... 75/338
4,762,553 8/1988 Savage et al. ..... 75/336

*Primary Examiner*—Stephen J. Lechert, Jr.
*Assistant Examiner*—Leon Nigohosian
*Attorney, Agent, or Firm*—Finnegan, Henderson, Farabow, Garrett & Dunner

[57] ABSTRACT

Titanium is induction melted to produce a molten mass thereof and a water-cooled crucible having a nonoxidizing atmosphere and a bottom opening. The current to the coil used for induction melting is adjusted to produce a levitation effect on the molten mass in the crucible to prevent the molten mass from flowing out of the bottom opening. The molten mass is also maintained out-of-contact with the crucible by providing a solidified layer of titanium between the molten mass and the crucible. After production of the molten mass of titanium, the current to the induction coil is reduced to reduce the levitation effect and allow the molten mass to flow out of the bottom opening of the crucible as a free-falling stream of molten titanium. This stream is struck with an inert gas jet to atomize molten titanium to form spherical particles. Spherical particles are cooled to solidify them and are then collected. The free-falling stream from the crucible may be directed to a tundish from which the molten mass flows through a nozzle for atomization. The titanium may be melted to form the molten mass outside the crucible with a molten mass then being introduced to the crucible.

3 Claims, 4 Drawing Sheets

METHOD FOR PRODUCING TITANIUM PARTICLES

BACKGROUND OF THE INVENTION

1. Field of the Invention

The invention relates to a method for producing titanium particles suitable for use in powder metallurgy applications. The particles are formed by inert gas atomization of molten titanium.

2. Description of the Prior Art

In various titanium, powder metallurgy applications, such as the manufacture of jet engine components, it is desirable to produce spherical titanium particles that may be subsequently hot compacted to form fully dense articles. Compacting is generally achieved by the use of an autoclave wherein the titanium particles to be compacted are placed in a sealed container, heated to elevated temperature and compacted at a high fluid pressure sufficient to achieve full density. For these applications, it is desirable that the titanium particles be spherical to ensure adequate packing within the container which is essential for subsequent hot compacting to full density. Nonspherical powders, when hot compacted in this manner, because of their low packing density, result in distortion of the exterior source of the compact. As described in U.S. Pat. No. 4,544,404 issued Oct. 1, 1985, it is known to produce spherical titanium particles for powder metallurgy applications by gas atomization of a free-falling stream of molten titanium metered through a nozzle of a tundish. With these practices, the titanium may be melted to form the required molten mass by practices including nonconsumable electrode melting of a solid charge of titanium.

In these conventional practices for inert gas atomization of titanium to form particles suitable for powder metallurgy applications, the melting practice employed, such as nonconsumable electrode melting, can result in contamination of the molten mass by the electrode material. In addition, to provide the controlled, free-falling stream required for effective atomization, metering through a nozzle is required. Consequently, the nozzle must be monitored to ensure that plugging of the nozzle or erosion of the nozzle do not significantly affect the metering of the stream of molten titanium to adversely affect inert gas atomization thereof. If the free-falling stream becomes greater than required, the atomization will not be complete to result in an excess amount of oversized, insufficiently cooled particles. On the other hand, if the stream is less than required, the molten titanium will freeze in the nozzle.

SUMMARY OF THE INVENTION

It is accordingly a primary object of the present invention to provide a method for producing titanium particles by inert gas atomization wherein contamination of the particles is avoided and a free-falling stream on molten titanium may be provided sufficient for atomization without requiring metering of molten titanium through a nozzle of a tundish.

A more specific object of the present invention is to provide a method for producing titanium particles that is adaptable for use with various combinations of apparatus and specifically does not require the use of a nozzle for metering the molten titanium for atomization.

In accordance with the invention, there is provided a method for producing titanium particles suitable for powder metallurgy applications by induction melting of titanium to produce a molten mass thereof in a water-cooled crucible. The crucible is provided with a nonoxidizing atmosphere. The crucible has a bottom opening to allow for the flow of molten metal from the crucible. The induction melting is performed by surrounding the crucible with an induction heating coil and admitting high frequency electric current to the coil to produce a rapidly changing magnetic field at high flux density to generate a secondary current in the titanium to heat the titanium to produce the molten mass. The current to the coil is adjusted to produce a levitation effect on the molten mass sufficient to prevent the molten mass from flowing out of the opening in the crucible. The molten mass of titanium is maintained out-of-contact with the crucible by providing a solidified layer of titanium between the molten mass and the crucible. This is achieved by adjusting the current to the coil to achieve proper heat control in combination with the effect of water cooling of the mold. After production of the molten mass of titanium, the current is reduced to the coil to in turn reduce the levitation effect on the molten mass sufficient to allow the molten mass to flow out of the opening as a free-falling stream of molten titanium. The free-falling stream is struck with an inert gas jet to atomize the molten titanium to form spherical particles. The particles are cooled to solidify the same and are then collected.

In accordance with an alternate embodiment of the invention, the free-falling stream of molten titanium from the crucible may be directed to a tundish having a nonoxidizing atmosphere therein. The tundish has a nozzle in a bottom opening thereof with the tundish and nozzle being lined with a solidified layer of titanium, whereby the molten titanium is maintained out-of-contact with the tundish and nozzle. Metering of the molten titanium from the tundish is achieved through the nozzle to form a free-falling stream. This free-falling stream from the tundish is struck with the inert gas jet to atomize the molten titanium to form spherical particles, which are then cooled to solidify the same and collected.

In an additional alternate embodiment of the invention, the titanium may be melted to form the molten mass and thereafter introduced to the crucible. The molten mass of titanium is introduced to the crucible at a flow rate equal to or exceeding that of the free-falling stream from the crucible.

DETAILED DESCRIPTION OF THE PREFERRED EMBODIMENTS

Figure 1:
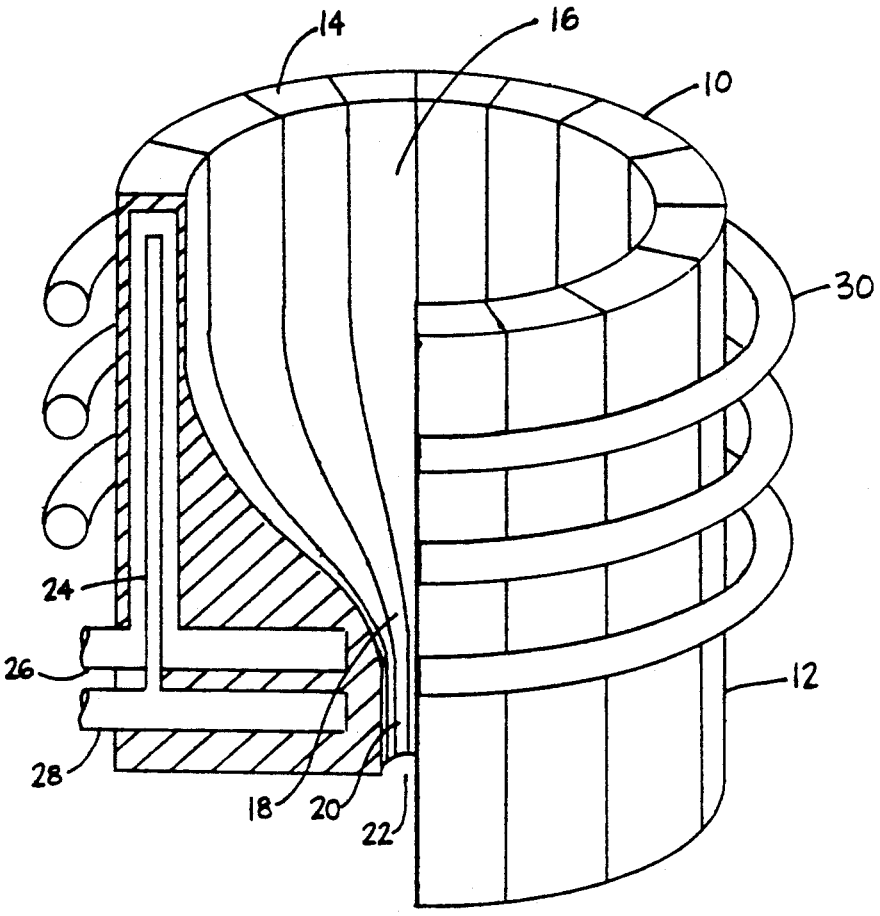
FIG. 1 is an elevational view in partial section of an embodiment of a crucible suitable for use in the practice of the method of the invention.

As shown in FIG. 1, a crucible, designated generally as 10, has a cylindrical body portion 12 constructed from plurality of copper segments 14. The segments 14 define an open top 16 of the crucible and have bottom curved portions 18 extending toward the longitudinal axis of the crucible to provide a bottom contoured portion 20 terminating in a central bottom opening 22. The segments 14 are provided with interior cooling water passages 24 to provide for the circulation of water for cooling the mold through water inlet 26 and water outlet 28. Induction heating coils 30 surround the crucible and are connected to a source of alternating current (not shown).

Figure 2:
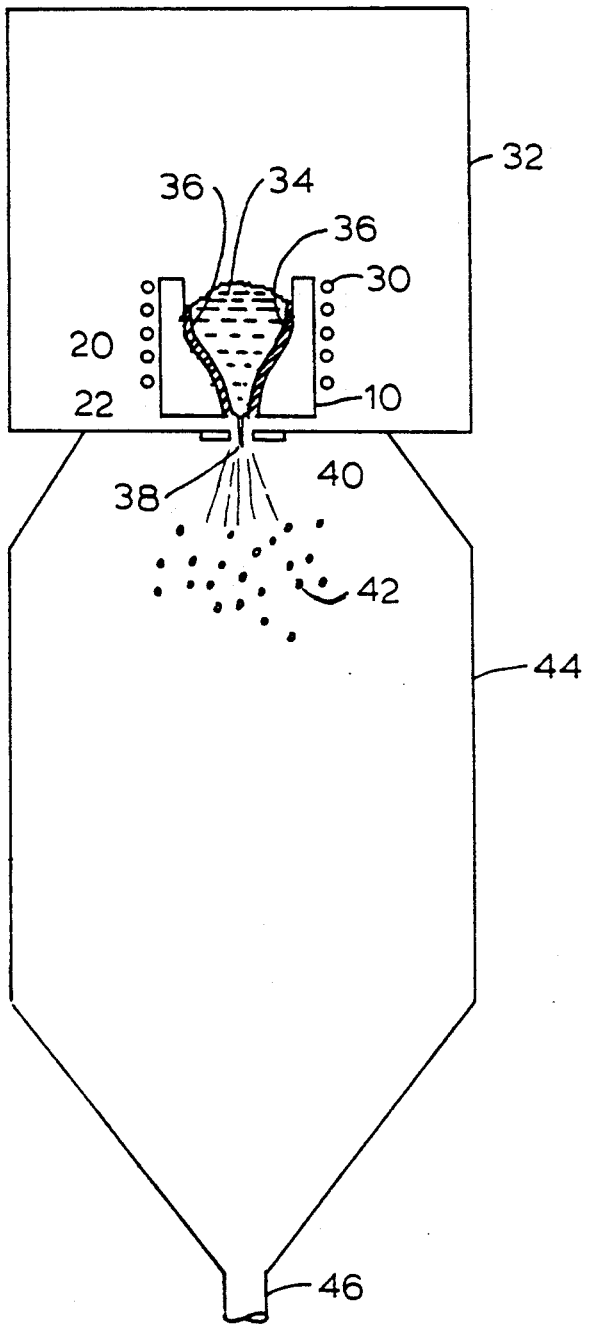
FIG. 2 is a schematic showing of apparatus suitable for the practice of one embodiment of the invention.

In the embodiment of the invention shown in FIG. 2, the crucible 10 is provided within a melt chamber 32 having a vacuum or nonoxidizing atmosphere which may be an inert gas, such as argon or helium. A charge of titanium in solid form (not shown) is introduced into the crucible 10 and is melted by induction melting to form a molten mass of titanium 34. This melting is achieved by introducing current to the induction melting coils to generate a secondary current in the titanium to heat the same in the well known manner of induction melting. By the regulation of the heat provided by the induction melting operation and the effect of the water cooled copper crucible, a skull of solidified titanium 36 is provided between the crucible and the molten mass of titanium therein. This protects the molten titanium from contamination by contact with the crucible.

When sufficient melting of the titanium has been achieved, the current to the induction heating coil is reduced by an amount sufficient to permit the molten mass of titanium to flow as a free-falling stream 38 through the bottom opening in the mold. The free-falling stream 38 is struck by inert gas from inert gas manifold 40 surrounding the free-falling stream to atomize the same into particles 42 which pass through atomizing tower 44 for cooling and solidification and are then collected from the bottom of the tower through opening 46.

During melting of the titanium in the crucible 10, the current to the induction coil is at a level sufficient to both melt the titanium and to produce a levitation effect on the molten mass of titanium in the crucible sufficient to prevent the same from flowing out of the bottom opening in the mold. When it is desired to withdraw the molten mass of titanium for atomization, the current is reduced to the coil and regulated to achieve the desired metering effect so that the free-falling stream of molten titanium is sufficient to achieve effective atomization. In this manner, use of a metering nozzle and the attendant problems thereof are avoided.

Figure 3:
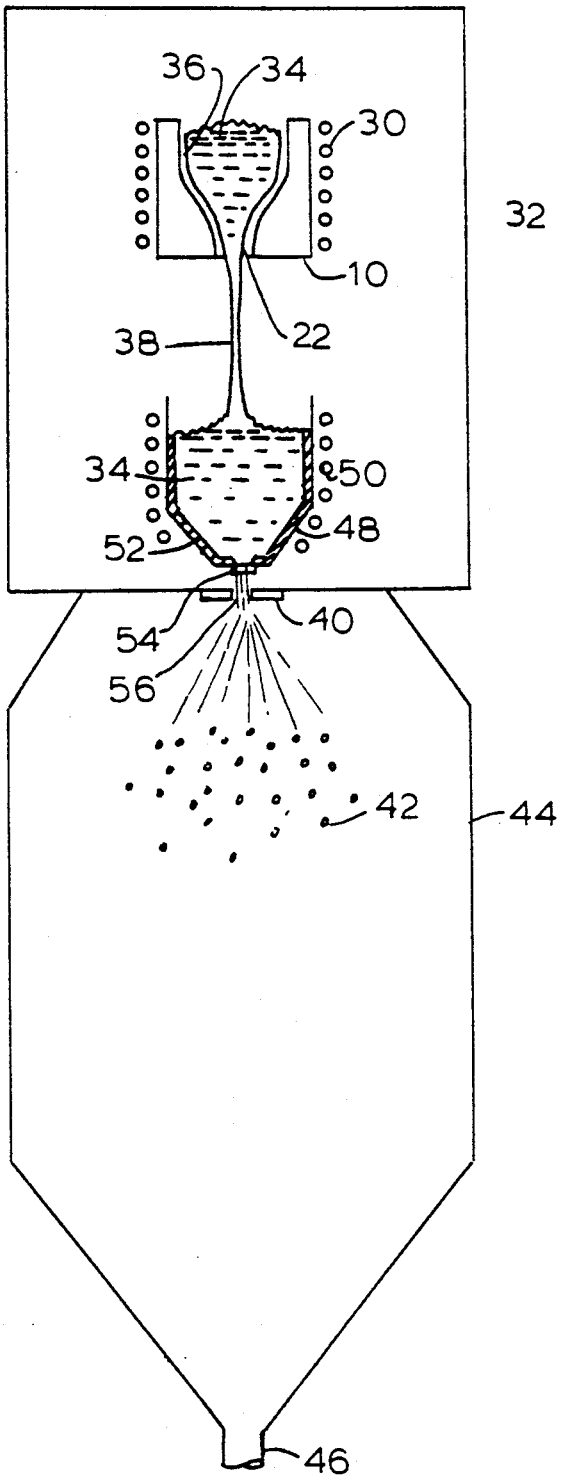
FIG. 3 is a schematic showing of apparatus suitable for use with a second embodiment of the invention.

In accordance with the embodiment of the invention shown in FIG. 3, the free-falling stream 38 from the mold 10 is introduced to a tundish 48 having an induction heating coil 50 associated therewith. As with the crucible 10, a skull of solidified titanium 52 is maintained in the tundish to avoid contamination of the molten mass 34 of titanium therein. In the bottom of the tundish a nozzle 54 is provided for metering the flow of the molten mass 34 out of the tundish bottom to form a free-falling stream 56. The stream 56 is atomized by inert gas from gas manifold 40 to produce particles 42 in the atomization tower 44 in a manner identical to that described with reference to the embodiment of FIG. 2.

The crucible and tundish are maintained within a melt chamber 32 having a vacuum or an inert gas atmosphere as described in accordance with the embodiment of FIG. 2.

Figure 4:
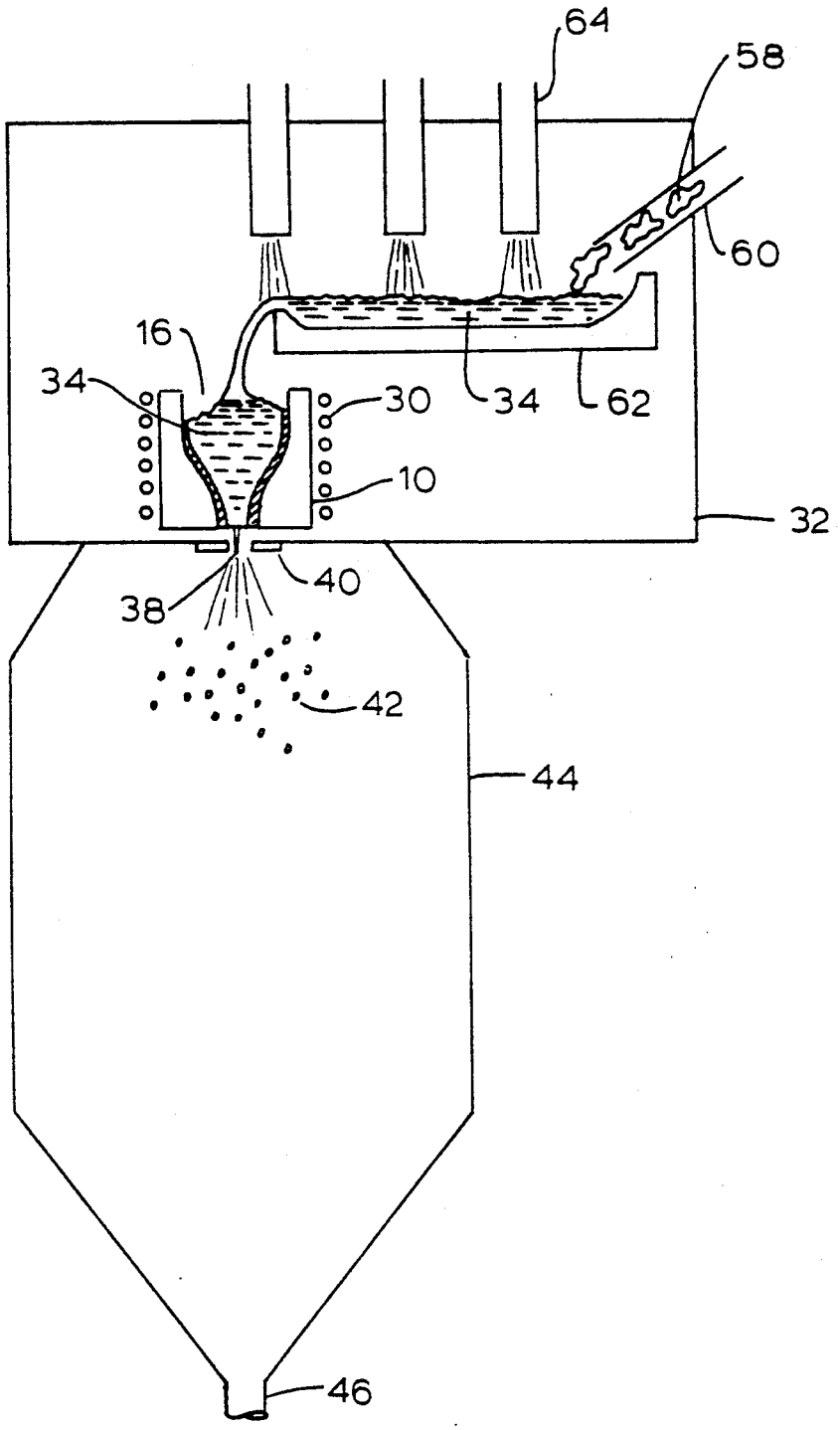
FIG. 4 is a schematic showing of apparatus suitable for use with a third embodiment of the invention.

In the embodiment of FIG. 4, solid titanium 58 is introduced into melt chamber 32 via shoot 60 to water-cooled cooper hearth 62. A series of plasma guns 64 are provided within the chamber 32 to heat the titanium 58 and form a molten mass 34 therefrom within the hearth 62. Arc melting could also be used. The molten mass 34 is introduced into the open top 16 of crucible 10. Thereafter, the operation is the same as that described with reference to the embodiment of FIG. 2. This embodiment provides the advantage of increased molten titanium throughput to the crucible 10 by increasing the melting capacity over that achieved by induction melting of solid titanium in the crucible. In addition, this embodiment of the invention provides for a continuous flow of molten titanium to the crucible to permit a continuous atomization operation.

It is to be understood that the term titanium as used herein in the specification and claims refers as well as to titanium-base alloys and titanium aluminide alloys.

As may be seen from the above-described embodiments of the invention, the invention permits the production of large quantities of molten titanium which may be efficiently maintained at a desired temperature for inert gas atomization without incurring contamination. In addition, the molten titanium may be removed from the crucible as a free-falling stream suitable for inert gas atomization without requiring metering of the molten mass through a nozzle for this purpose in accordance with prior-art practices.

What is claimed is:

1. A method for producing titanium particles suitable for powder metallurgy applications, said method comprising induction melting titanium to produce a molten mass thereof in a melt chamber containing a water-cooled crucible with a vacuum or a nonoxidizing atmosphere therein and having a bottom opening with no nozzle provided therein, said induction melting being performed by surrounding said crucible with an inducting heating coil and admitting high frequency electrical current to the coil to produce a rapidly changing magnetic field at high flux density to generate a secondary current in the titanium to heat the titanium to produce the molten mass within said crucible, adjusting the current to the coil to produce a levitation effect on the molten mass sufficient to prevent the molten mass from flowing out of the opening in the crucible, maintaining the molten mass out-of-contact with the crucible by providing a solidified layer of titanium between the molten mass and the crucible by adjusting the current to the coil, after production of the molten mass reducing an regulating the current to the coil to reduce the levitation effect on the molten mass sufficient to meter and allow the molten mass to flow out of the bottom opening as a metered, free-falling stream of molten titanium in an amount sufficient to achieve effective atomization, striking the free-falling stream with an inert gas jet to atomize the molten titanium to form spherical particles, cooling the spherical particles to solidify the particles and collecting the solidified particles.

2. The method of claim 1 comprising, directing said free-falling stream from said crucible to a tundish having a nonoxidizing atmosphere therein and having a nozzle in a bottom opening thereof, said tundish and nozzle being lined with a solidified layer of titanium, whereby the molten titanium is maintained out-of-contact with the tundish and nozzle, metering molten titanium from the tundish through the nozzle to form a second free-falling stream, striking the second free-falling stream with an inert gas jet to atomize the molten titanium to form spherical particles, cooling the spherical particles to solidify the particles and collect the solidified particles.

3. The method of claim 1 comprising melting said titanium to form said molten mass and introducing said titanium as the molten mass to the crucible, with the molten mass being introduced to the crucible at a flow rate equal to or exceeding that of the free-falling stream from the crucible.

* * * * *